United States Patent [19]

Spuck, III

[11] 4,167,111

[45] Sep. 11, 1979

[54] BOREHOLE GEOLOGICAL ASSESSMENT

[75] Inventor: William H. Spuck, III, Arcadia, Calif.

[73] Assignee: The United States of America is represented by the Administrator of the National Aeronautics & Space Administration, Washington, D.C.

[21] Appl. No.: 903,019

[22] Filed: May 4, 1978

[51] Int. Cl.[2] ..... E21B 47/10

[52] U.S. Cl. ..... 73/155; 175/78

[58] Field of Search ..... 73/155, 151, 84, 155; 324/10; 175/50, 77, 78

[56] References Cited

U.S. PATENT DOCUMENTS

| | | | |
|---|---|---|---|
| 2,747,401 | 5/1956 | Doll | 73/151 |
| 3,289,474 | 12/1966 | Smith | 73/155 |
| 3,301,337 | 1/1967 | Vaughn et al. | 175/77 X |

*Primary Examiner*—Jerry W. Myracle

*Attorney, Agent, or Firm*—Monte F. Mott; John R. Manning; Wilfred Grifka

[57] ABSTRACT

A method and apparatus are provided for performing geological assessments of a formation located along a borehole, which includes a boring tool that bores a pair of holes into the walls of the borehole and into the surrounding strata, and a pair of probes installed in the holes. One of the probes applies an input such as a current or pressured fluid, and the other probe senses a corresponding input which it receives from the strata. The boring tool can include a series of rigid bore segments that can be easily installed in a housing that lies in the borehole, and apparatus for connecting the bore segments in series while also advancing them into the strata surrounding the borehole, so that a straight hole can be bored in the strata.

9 Claims, 11 Drawing Figures

FIG. 9
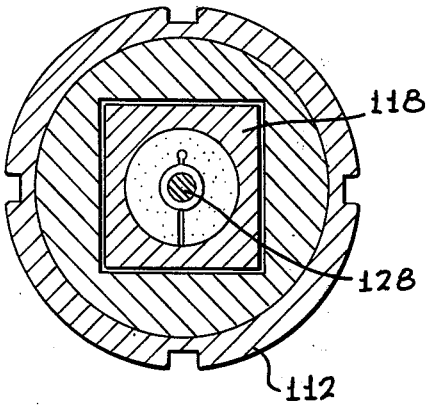
FIG. 10
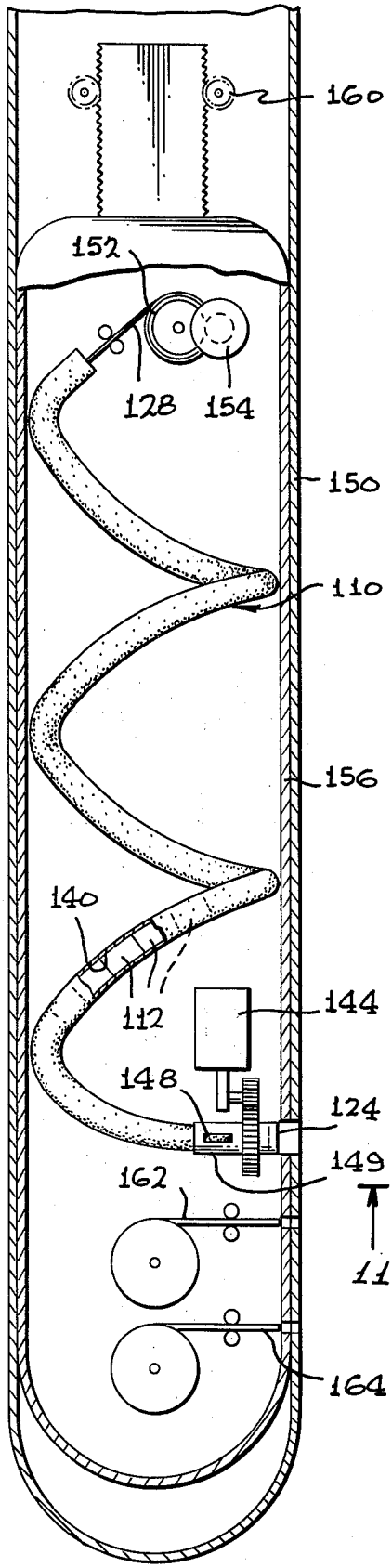
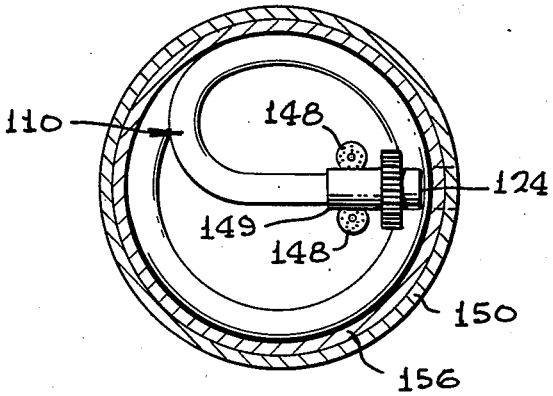
FIG. 11

BOREHOLE GEOLOGICAL ASSESSMENT

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

A variety of techniques are utilized to assess the potential oil recovery from existing boreholes, by making measurements in the borehole indicating the characteristics of the surrounding strata. These techniques include sonic, resistivity, radioactivity (neutron), gravimetry and dielectric constant logging, as well as detailed studies of core samples removed in drilling the borehole and flow rate tests. However, these techniques all have shortcomings since they are affected by the fact that the walls of the borehole have been disturbed by drilling so they have undergone changes such as in internal pressures, and are caked by drilling mud, all of which can lead to inaccurate assessments. Techniques which enabled the measurement of formation characteristics by probes brought to the formation by way of a borehole, while minimizing the effects on the measurements of localized changes caused by the drilling of the borehole, would enable the making of more accurate geological assessments.

SUMMARY OF THE INVENTION

In accordance with one embodiment of the present invention, a method and apparatus is provided for enabling more accurate geological assessments of the strata surrounding a borehole. This is accomplished by boring a deep hole of a length of many borehole diameters away from the borehole and placing a probe thereat, so that the probe can take measurements at a relatively undisturbed location. A pair of such holes can be formed to position two probes at closely spaced locations within the formation, and an input such as a current or pressured fluid, can be applied through one probe and sensed through the other to obtain an indication of the formation characteristics. Before a fluid is pumped out of the end of the probe, the probe can be sealed to the hole in which it lies, as by an inflatable seal, to prevent fluid from gathering in the portions of the hole other than the ends.

One way of boring a deep side hole for a probe or for obtaining a core sample, by means of a device lowered down a narrow borehole, includes the connection of a series of rigid bore segments progressively together as the bore segments are advanced into the surrounding strata. This provides a relatively rigid boring tool to assure that the side hole extends substantially along a straight line, and enables such a rigid boring tool to be accommodated in a relatively narrow housing that can pass down the borehole.

The novel features of the invention are set forth with particularity in the appended claims. The invention will be best understood from the following description when read in conjunction with the accompanying drawings.

BRIEF DESCRIPTION OF THE DRAWINGS

FIG. 9 is a view taken on the line 9—9 of FIG. 7.

FIG. 10 is a sectional side view of a housing which holds the apparatus of FIG. 7.

FIG. 11 is a view taken on the line 11—11 of FIG. 10.

DESCRIPTION OF THE PREFERRED EMBODIMENTS

Figure 1:
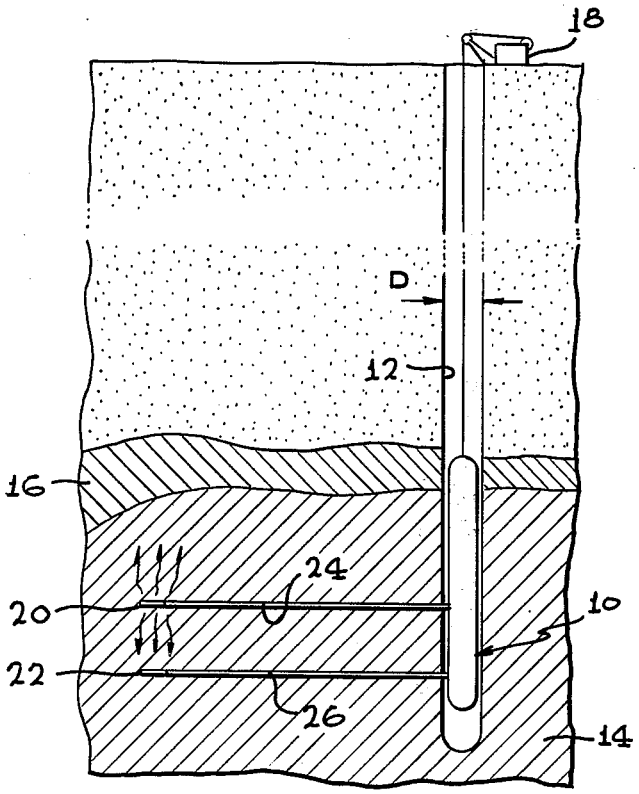
FIG. 1 is a sectional side view of a borehole geological assessment apparatus, showing how it is utilized near the bottom of a borehole.

FIG. 1 illustrates a geological assessment device 10 which has been lowered into a previously drilled borehole 12, down to the level of a porous sandstone structure 14 that contains oil and that underlies a shale capstone layer 16. When the assessment device 10 has been lowered as by a winch 18, to a desired depth along the borehole, the device installs a pair of probes 20, 22 into side holes 24, 26 that have been bored into the side wall of the borehole 12 and deeply into the surrounding strata. One of the probes 20 delivers an input in the form of a tagged fluid into the strata 14, while the other probe 22 is constructed to sense the flow of that input into its hole 26, to provide an indication of the nature of the strata, and particularly the amount and rate at which oil may be obtained therefrom, as for example by an enhanced oil recovery process.

Figure 2:
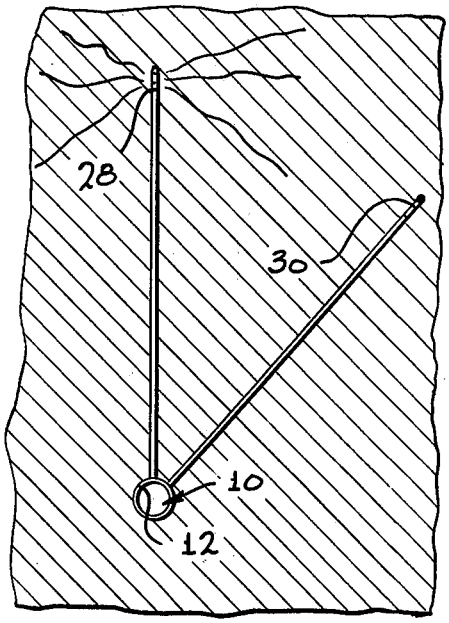
FIG. 2 is a sectional top view of a geological assessment apparatus utilized in accordance with another embodiment of the invention.

The probes in FIG. 1 are vertically spaced, but it is possible to space them in any other manner. FIG. 2 illustrates a pair of probes 28, 30 lying at the same height, but extending from the borehole 12 in directions angularly spaced about the axis of the borehole. One of the probes 28 may apply an input such as a current, which is returned by the other probe 30. Any one of a number of conventional well logging devices may be similarly placed, but the present method is especially useful where the log benefits from the transmission of an input through the undisturbed formation for some distance.

Figure 3:
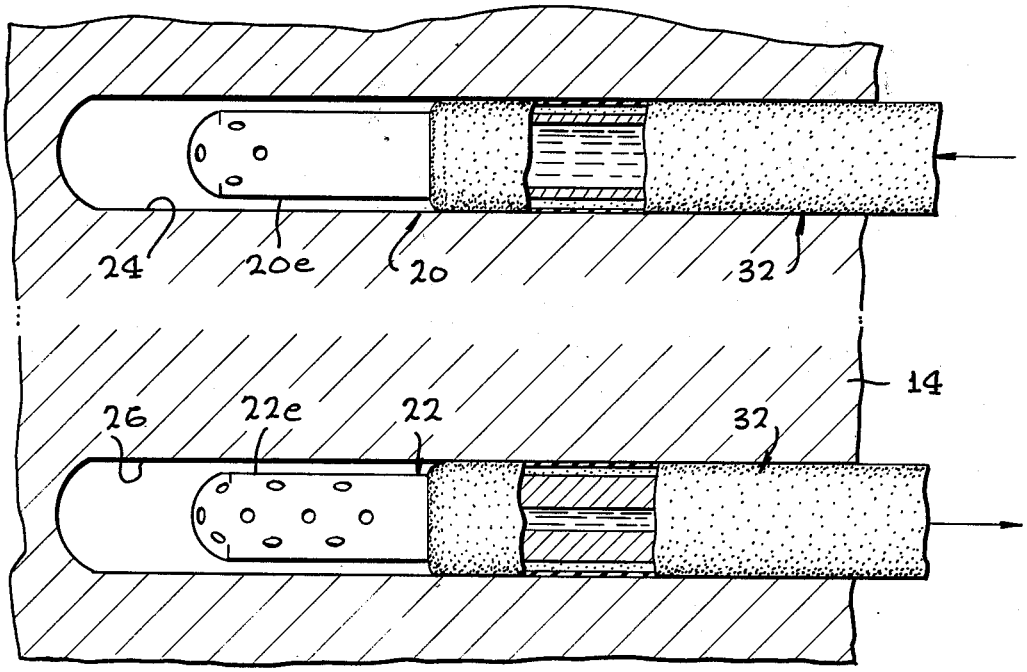
FIG. 3 is a sectional side view of a portion of the apparatus of FIG. 1.

FIG. 3 illustrates end portions of the probes 20, 22 of FIG. 1. The probe 20 has an end portion **20*e* with holes that emit pressured fluid, while the other probe has an end portion 22*e* that can receive fluids. In order to prevent the fluid from accumulating in the rest of the side holes 24 or 26, packers 32 are placed around a significant length of the probes to seal them to the walls of the side holes. The packer 32 includes an inflatable elastomeric member which can be inflated as by a $CO_2$ cartridge to expand the member against the walls of the side hole. With fluid pumped under pressure into the probe 20, and with a relative vacuum applied to the other probe 22 to draw out fluid, an indication of the permeability of the strata can be obtained. The side holes 24, 26** should be long enough so that the probe end portions are located a plurality of bore hole diameters D away from the borehole so that the mud caking on the borehole walls, the mechanical disturbance of the borehole walls, the empty space formed by the borehole, and the stress relief immediately about the borehole all have minimal effect upon the measurements.

Figure 4:
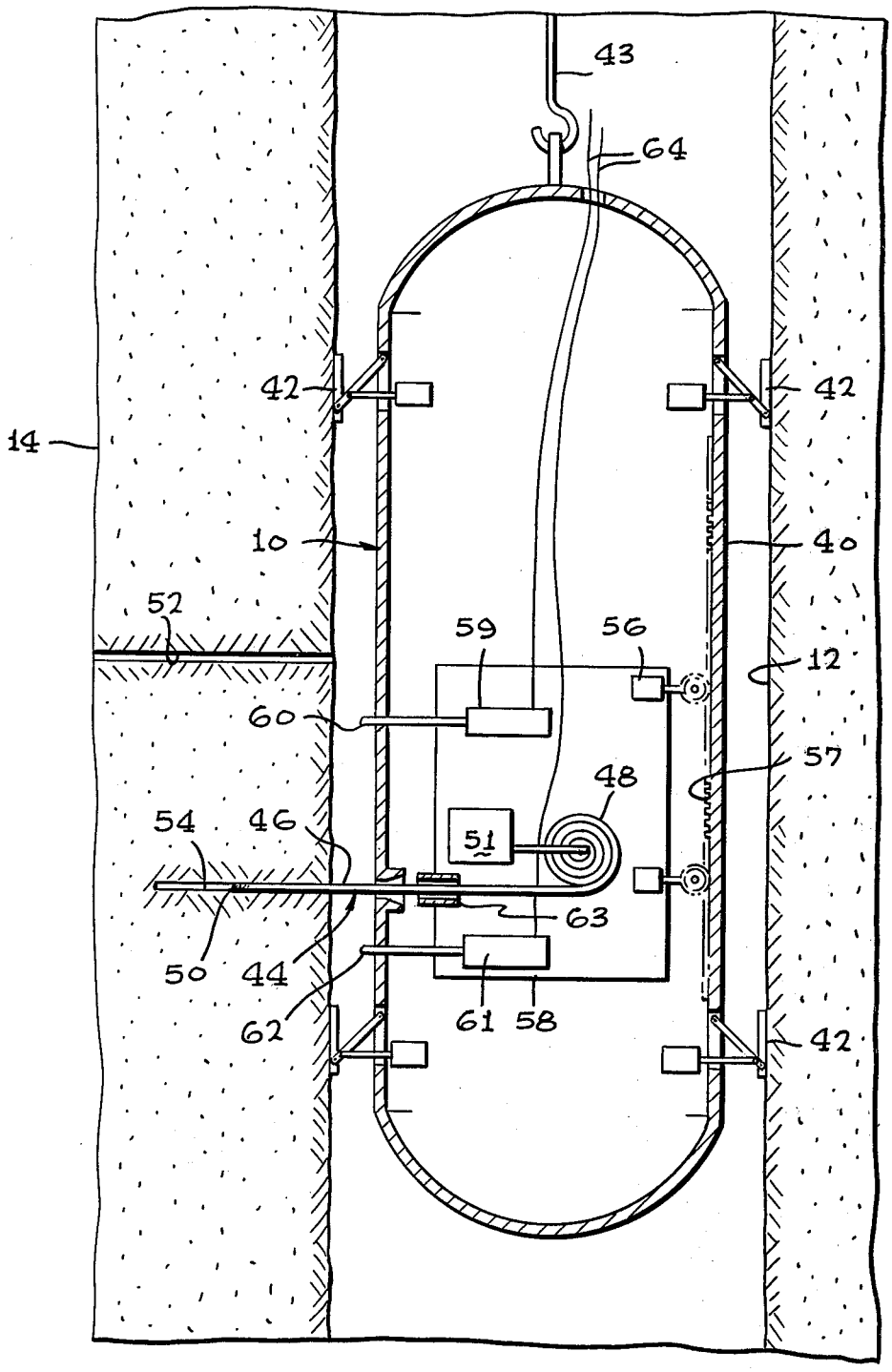
FIG. 4 is a simplified sectional view of a geological assessment apparatus, shown during the boring of a hole into the strata surrounding a borehole.

FIG. 4 illustrates a simplified geological assessment device 10, which must bore holes into the strata surrounding the borehole and emplace a pair of probes therein. The device includes a narrow housing 40 for fitting down the borehole 12 which may have a diameter such as six inches. A group of clamps 42 hold the housing firmly at a particular position within the borehole to which the device has been lowered by a cable 43. A boring tool 44 is shown as including a flexible fluid-carrying member 46 which is originally wound in reel 48, and which is supplied with pressured fluid that flows out through an end 50 of the tool as it is unwound from the reel, to bore a deep hole into a soft strata 14 surrounding the borehole. A pump 51 pumps fluid lying in the borehole or formation into the tool. In this connection, it should be noted that packers can be utilized instead of clamps 42, to seal out drilling mud and allow formation fluids to enter the apparatus to be used for boring or as a drilling fluid. The boring tool has already bored one hole 52 and is now boring a second hole 54 whose end will be closely spaced from the first hole. After each boring, the reel 48 is rewound to withdraw the boring tool from the hole. After the first hole 52 was formed, a stepping motor 56 that drives a gear engaging a rack 57, advanced a frame 58 to the position at which the next hole 54 was to be formed. After the second hole has been formed and the boring tool retracted, the frame 58 is raised until probe deploying means 59, 61 and a pair of probes 60, 62 are moved into positions previously occupied by the bore tool deploying means formed by tool guides 63, so that the probes are aligned with the holes 52, 54. The probes 60, 62 are then extended into the holes. The probes may include, for example, a flexible, inflatable tube, wound on a reel and having a current carrying electrode at its end. An electrical cable 64 extends from the frame 58 up to the surface of the earth, where technicians control the operation of the device and measure the input and output of the probes. Instead of moving the boring tool and probes vertically, they could be turned about the axis of the borehole by utilizing a ring gear instead of rack 57.

Figure 5:
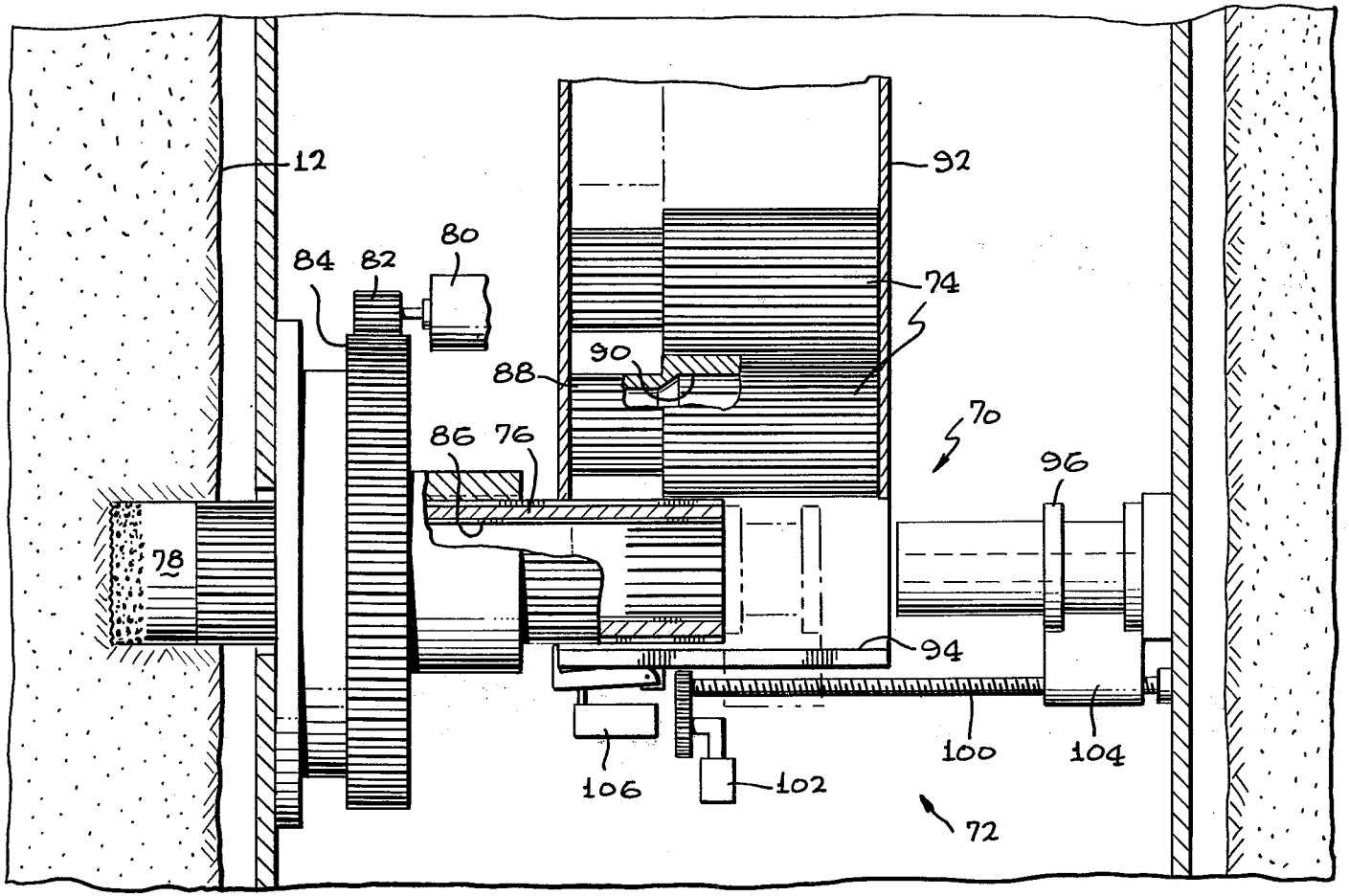
FIG. 5 is a partial sectional view of a geological assessment apparatus constructed in accordance with another embodiment of the invention.

In the boring of side holes, it is normally desirable to form the holes by mechanical drilling, to provide minimum disturbance of the strata and to enable boring into the strata of a variety of hardnesses. A simple rigid drill rod could be used for drilling a sidehole, except that a typical borehole has a small diameter such as six inches, so that such a drill could be only 6 inches long if it drilled perpendicular to the axis of the borehole, and only about 8 inches long even if it drilled at a 45° angle to the borehole axis. A flexible shaft could be used to drill a long sidehole, since such a shaft could be stored in a coil or along the length of the borehole. However, a flexible shaft could not be relied upon to drill a straight hole, and wound tend to drill in a circle. Electronic controls could be utilized to sense the direction of drilling and cause drilling to occur along a straight line, but this would add considerably to the complexity and cost of the apparatus. FIG. 5 illustrates a boring tool 70, which lies within a geological assessment apparatus 72 that has been lowered down along a borehole 12, and which can mechanically drill a straight sidehole.

The boring tool 70 of FIG. 5 includes a group of substantially rigid bore section or segment members 74 that can be connected in series with one another and with a foremost member 76 that carries a drill head 78. The bore members are rotated by a motor 80 whose output shaft is connected through a pinion 82 to a large gear 84 which has a splined hole 86. Each of the bore members, including the leading member 76, has a splined outer surface that matches the splined hole 86 of the larger gear, so that as the gear 84 turns it turns the bore member lying therewithin. The bore members are also connected to one another by means of splined key portions 88 at the front of each section 74, that fit into a splined hole 90 at the rear of each bore member, to cause all bore members to turn together. This engagement of the bore members also assures that they will all lie along substantially a straight line when they are connected together, so that the hole that they drill into the strata is substantially straight, and therefore the probes can be accurately positioned.

The bore section members 74 are held in a cartridge 92 that permits one bore member at a time to fall into a cradle guide 94. When a bore member 74 falls into the cradle guide, its key portion 88 is pushed into the bore member ahead of it by an actuator 96. The actuator not only pushes successive bore members into one another, but also maintains presusre against the string of bore members to keep the drill head 78 pressed firmly against the strata as it turns. The mechanism for advancing the actuator and maintaining forward pressure on it while it advances each bore member, can include a screw 100 turned by a motor 102. The screw engages a coupling 104 connected to an end of the actuator 96 to move the coupling. As each bore member passes an end of the cradle, a switch 106 senses the bore member to cause the motor to retract the actuator. The boring tool 70 is not retractable, and therefore the probe must be placed in the head portion of the tool, as by providing holes near the drill head 88 through which pressured water can be pumped out into the strata.

Figure 8:
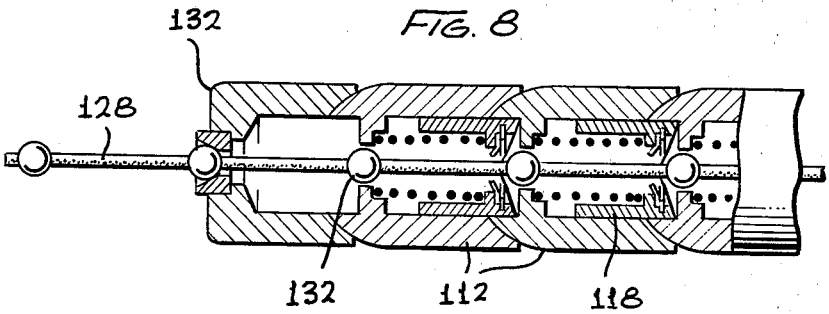
FIG. 8 is a sectional view of a rear end portion of the apparatus of FIG. 6.

FIGS. 6–9 illustrate a boring tool 110 composed of segments 112 with sperically rounded ends, one end 114 being convex and the adjacent end 116 of the next member being concave. The curved ends of the members allow them to be contained within a curved tube so that a long string of the members 112 can be contained in a narrow housing. When the members 112 are aligned with one another, a key 118 of one member is urged by a spring 120 into a socket 122 of the next member, with the socket 122 being formed to closely receive the key 118. This causes the members to remain aligned so that a straight side hole can be drilled, and also permits the members to transmit torque through one another so that the drill head 124 of the foremost member 126 can be turned to drill a hole. The bore members 122 are held in spring loaded contact by a steel cable 128 that runs the full length of the series of members. In order to maintain the cable under tension, a helical compression spring 130 is located in the drill head bore member 126, and the rearward end of the cable is anchored to the last bore member 132 (FIG. 8).

After the side hole has been drilled into the strata surrounding the bore hole, the string of bore members can be retracted by pulling on the cable 128. In order to permit retraction of the string of bore members into the narrow housing that fits in the borehole, provisions are made for the string of drill members to bend so as to turn from the horizontal to the vertical to fit into the narrow housing. This is accomplished by providing a series of spherical lugs 132 that are swaged onto the cable 128, with the lugs spaced apart by distances equal to the spacing of the bore members 112 along the cable. When a large tensile force is applied to the cable and to the last bore member 132, the lugs on the cable will overpower the springs 120 within the bore members to retract each key 118 of a bore member from the socket 122 of the next bore member. The drill assembly formed by the string of bore members can then be retracted into a curved tube or other storage areas extending along the length of the housing that lies in the bore hole.

The drill string formed by the bore members 112 can be turned by providing splines on the outside of the members which are driven by a mechanism similar to that shown in FIG. 5. Although rotation can be utilized, an oscillating motion is preferred, since only the aligned bore members are keyed together to rotate, and there is danger of twisting the rearward portion of the cable which extends through non-aligned bore members.

Figure 6:
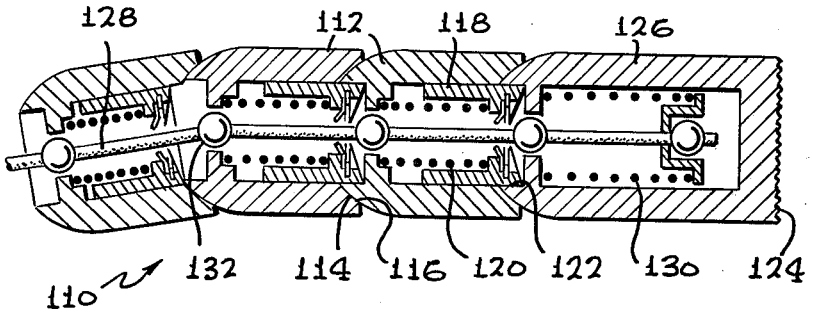
FIG. 6 is a partial sectional view of a geological assessment apparatus constructed in accordance with another embodiment of the invention.
Figure 7:
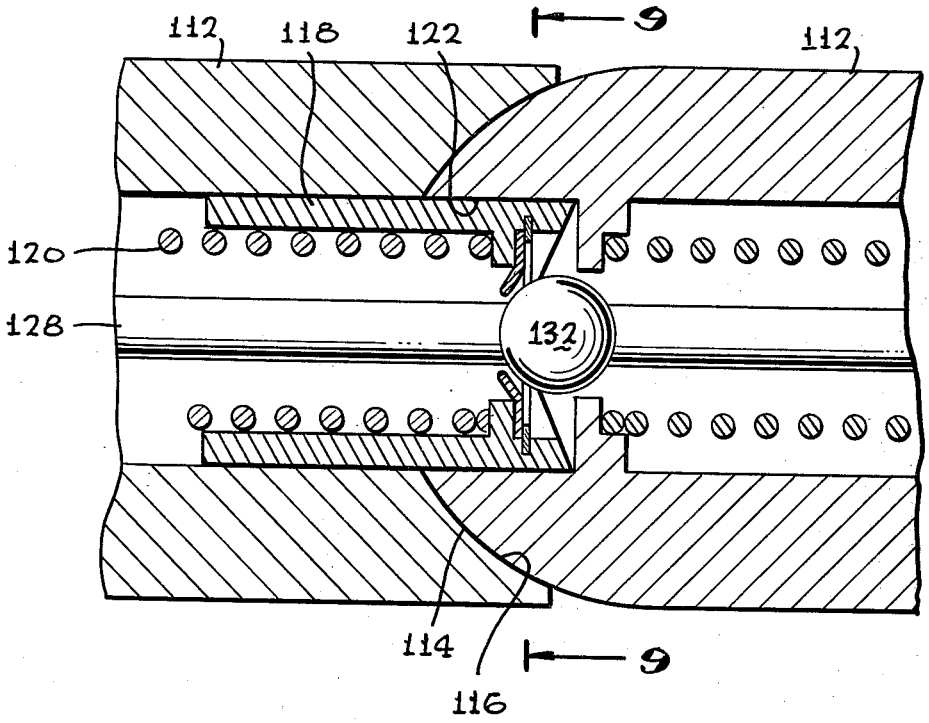
FIG. 7 is an enlarged view of a portion of the apparatus of FIG. 6.

FIGS. 10 and 11 illustrate a system utilizing the drill string 110 of FIG. 6 which includes a spiral tube 140 which holds a series of bore members 112 out of alignment, and a motor 144 which turns the drill string. A pair of rubber rollers 148 advance the drill string along a straight guideway 149 out of the housing 150 and into the surrounding strata. A drum 152 unwinds the cable 128 as the drill string advances into the surrounding strata. A motor 154 thereafter turns the drum 152 to rewind the cable 128 so as to withdraw the drill string back into the tube 140. After the drill string has been withdrawn, a housing portion 156 which includes the drill string, is lifted up by a pair of motor driven gears 160, to bring the drill head 124 into a position to bore a second hole in the surrounding strata. After the second hole has been bored and the drill string is retracted, the housing portion 156 is again lifted, to bring a pair of probes 162, 164 into alignment with the two holes that have been drilled. The probes 162, 164 can be unwound from reels and pushed into the holes.

The probes can apply a variety of inputs to the surrounding strata and sense a variety of corresponding outputs, including currents, fluids, radioactive emissions, etc. Also, the boring apparatus can be of a hollow type for producing core samples.

Thus, the invention provides a method and apparatus for providing geological assessments of the formation surrounding a borehole. This can be accomplished by installing a pair of probes in the formation at locations that are spaced with respect to the borehole, to minimize the effect of the borehole and the drilling mud utilized in forming the borehole, on the measurements taken on the strata. A variety of boring devices can be utilized, including a device that emits a boring fluid, and a variety of drilling devices.

Although particular embodiments of the invention have been described and illustrated herein it is recognized that modifications and variations may readily occur to those skilled in the art, and consequently, it is intended that the claims be interpreted to cover such modifications and equivalents.

What is claimed is:

1. Apparatus for performing a geological assessment of a formation located along a borehole, comprising:

a housing for passing down a borehole;

a pair of probes mounted to said housing;

means for installing said probes through the walls of a borehole in which said housing lies, to a pair of positions in the formation that lies about said borehole, that are spaced from one another and that extend by a plurality of borehole diameters from the borehole into the formation; and means for applying an input through a first of said probes into the surrounding strata, and means for sensing a corresponding input received by a second of said probes from the strata.

2. The apparatus described in claim 1 wherein:

said applying means applies an electrical current through said first probe into said strata.

3. The apparatus described in claim 1 wherein:

said applying means applies fluid under pressure through said first probe to inject the fluid into said strata.

4. The apparatus described in claim 3 wherein:

said probe includes a conduit with an open end portion; and said applying means includes an inflatable body disposed about a portion of said conduit, for sealing a length of said hole which lies between the probe end portion and the borehole, to resist the accumulation of injected fluid about the first probe.

5. The apparatus described in claim 1 wherein:

said installing means is constructed to install said probes at positions angularly spaced about the axis of the borehole.

6. The apparatus described in claim 1 wherein:

said installing means is constructed to install said probes at vertically spaced locations.

7. Apparatus for installing a probe deeply into the strata surrounding a borehole, comprising:

a housing for passing down a borehole;

bore tool deploying means mounted in said housing for deploying a boring tool from a bore deploy location on said housing against the walls of the borehole and deeply into the strata surrounding the borehole;

probe deploying means spaced from said bore tool deploying means for deploying a probe deeply into a hole in said strata; and means for moving said bore tool deploying means away from said bore deploy location, and for moving said probe deploying means substantially into said bore deploy location, to enable said probe deploying means to deploy the probe into the hole formed by the boring tool without moving the housing.

8. A method for geologically assessing an underground formation located along a borehole, comprising:

boring a hole in a primarily horizontal direction from a location deep within said borehole into the wall of said borehole and into the surrounding strata, to a location which is spaced from said borehole by a distance of a plurality of diameters of said borehole;

placing a probe in said hole;

sealing at least a portion of said hole lying between the outer end portion of the probe and the hole; and pumping fluid through the outer end portion of said probe.

9. A method for geologically assessing an underground formation located along a borehole, comprising:

boring a pair of holes in a primarily horizontal direction from a location deep within said borehole into the wall of the borehole and into the surrounding strata to positions which are spaced from one another and from the borehole;

inserting a pair of probes into said hole; and applying an input through a first of said probes into the surrounding strata, and sensing a corresponding output from the other probe;

said step of applying an input including passing a current through an end portion of said first probe into said strata.

* * * * *